US005203580A

United States Patent [19]

Cunningham

[11] Patent Number: 5,203,580

[45] Date of Patent: Apr. 20, 1993

[54] CANOE TOTER WITH WHEEL STABILIZERS

[76] Inventor: Brian J. Cunningham, 60 Summer Sr., Hanover, Mass. 02339

[21] Appl. No.: 745,010

[22] Filed: Aug. 14, 1991

[51] Int. Cl.[5] ..... B62B 1/00; B62B 5/00

[52] U.S. Cl. ..... 280/47.331; 280/414.2; 188/31; 188/69

[58] Field of Search ..... 280/47.331, 79.6, 414.1, 280/414.2, 414.3; 114/344; 188/19, 20, 31, 32, 56, 57, 69

[56] References Cited

U.S. PATENT DOCUMENTS

| | | | |
|---|---|---|---|
| 200,856 | 3/1878 | Curren | 188/20 |
| 484,873 | 10/1892 | Birkholz | 188/20 |
| 799,857 | 9/1905 | Loftus | 188/31 |
| 1,248,200 | 11/1917 | Suggs | 188/31 X |
| 2,437,736 | 3/1948 | Good | 114/344 |
| 2,540,279 | 2/1951 | Mosier | 280/414.2 |
| 2,970,846 | 2/1961 | Boston | 280/414.2 X |
| 3,445,018 | 5/1969 | Reagan | 280/47.331 X |
| 3,462,781 | 8/1969 | Olvera | 280/47.331 X |
| 3,687,476 | 8/1972 | Abbott | 280/414.2 X |
| 4,422,665 | 12/1983 | Hinnant | 280/414.2 |
| 4,429,893 | 2/1984 | Palamara | 114/344 X |
| 4,579,357 | 4/1986 | Webster | 280/47.331 |
| 4,795,178 | 1/1989 | Nabarrete | 280/47.331 |
| 4,936,595 | 6/1990 | Cunningham | 280/47.331 |
| 5,072,959 | 12/1991 | Marullo | 280/47.331 |

FOREIGN PATENT DOCUMENTS

| | | | |
|---|---|---|---|
| 326446 | 9/1920 | Fed. Rep. of Germany | 280/47.331 |

*Primary Examiner*—Brian Johnson

*Attorney, Agent, or Firm*—Wolf, Greenfield & Sacks

[57] ABSTRACT

A canoe toting apparatus which enables an individual to manually mount and transport a canoe or similar marine craft over reasonable distances includes a pair of large diameter wheels rotatably mounted on opposite ends of an adjustable length axle. Wheel stabilizers, coupled to the axle, may be pivoted into interfering engagement with the wheels to prevent the wheels from rotating while the marine craft is positioned on the toting apparatus. A pair of resilient guide members are slidably mounted over the axle and adapted to receive the underside of the marine craft. An adjustable length strap, coupled to the axle, is securable about the gunwales of the craft to secure the craft against the toting apparatus.

17 Claims, 3 Drawing Sheets

CANOE TOTER WITH WHEEL STABILIZERS

FIELD OF THE INVENTION

The present invention relates to the field of boat transportation, and more specifically, to a utility device for transporting a canoe or similar marine craft. The present invention provides a canoe toter which enables an individual to mount and manually transport a canoe over reasonable distances.

BACKGROUND OF THE INVENTION

A variety of apparatus are commercially available for transporting marine crafts of sizes ranging from kayaks to yachts. For medium to large boats, the apparatus usually consists of a trailer which serves as a means for both transporting and launching the boat. Such devices are disclosed in U.S. Pat. Nos. 4,422,665, Hinnant; 3,445,018, Regan, and 2,437,736, Good.

Smaller marine vehicles, such as kayaks, canoes or small sail boats, do not require a trailer type vehicle because of the reduced size and weight of the craft. For such smaller marine craft, transportation racks, attachable to the roof of an automobile, are available. Unfortunately, such rack type apparatus provide no assistance in launching the craft. Furthermore, with smaller crafts, such as canoes and kayaks, the desired body of water is often remote from any roads or paths which are accessible to automobiles. Consequently, the user must dismount the craft from the automobile and manually carry the craft the remaining distance. It is not uncommon for boating and canoeing enthusiasts to manually carry canoes a mile or more to the desired body of water. Unfortunately, it is often impractical and even dangerous for a lone individual to carry a canoe or other craft any distance greater than several hundred feet due to the considerable physical fatigue and stress result from the weight of the craft.

U.S. Pat. No. 4,936,595, Cunningham, discloses a canoe toter apparatus which enables a single individual to manually transport a canoe or similar marine craft over reasonable distances. The device disclosed in Cunningham addresses some of the above described problems with traditional apparatus for transporting marine crafts. In particular, the disclosed device includes an axle on which the marine craft rests, with wheels attached to each end of the axle. Once the individual has placed the marine craft on top of the axle, it may be awkward or cumbersome to slide the craft relative to the axle for more exact placement. Forces applied to the marine craft are transferred, because of the frictional engagement between the craft and the axle, to the wheels, causing the canoe and toter apparatus to move in unison. As a result, several attempts may be required before obtaining the desired placement of the craft on the apparatus.

In addition, many current marine craft transporting devices ride relatively close to the ground and may not be high enough to clear many of the natural obstructions which are present in the terrain. Further, when the axle is disposed close to the ground, the angle at which the user must grasp or pull the craft may create physical discomfort over extended periods.

It is therefore an object of the present invention to provide a canoe toter which simplifies the task of positioning a canoe or other small marine craft on the toter apparatus.

Further, another object of the present invention is to provide a canoe toter which enables a single individual to manually slide a canoe or other small marine craft with respect to the toter apparatus without movement of the toter itself.

Another object of the present invention is to provide a canoe toter which allows the canoe or other small marine craft to ride at a level which is high enough to clear most obstructions and which allows the user to grasp the canoe more comfortably.

Another object of the present invention is to provide a canoe toter which enables a single user to manually transport a canoe or other small marine craft over extended distances.

A further object of the present invention is to provide a canoe toter which is strong, durable and able to withstand extended wear and abuse from the environment.

Yet another object of the present invention is to provide a canoe toter which is adaptable to a variety of canoe sizes and which itself can be reduced in size to facilitate ease of storage and transportation when not in use.

BRIEF SUMMARY OF THE INVENTION

The foregoing and other objects of the present invention are achieved with a canoe toter which enables an individual to manually mount and transport a canoe or other similar marine craft over reasonable distances.

According to one embodiment of the present invention, a canoe toter comprises a pair of wheels mounted on opposite ends of an adjustable length axle which may accommodate canoes or marine craft of varying sizes. A pair of wheel stabilizers, one pivotally attached at each end of the axle, are rotatable into interfering engagement with the wheels to prevent the wheels from rotating when positioning a craft on the canoe toter. A pair of resilient guide members, slidably mounted on the axle top surface, receive the underside of the marine craft. A flexible, adjustable-length strap is attached to the axle and may be secured over the gunwales of the marine craft to secure it to the canoe toter.

The canoe is mounted slightly off center so that, when fishing or other gear are stowed in the canoe, the canoe is approximately balanced over the toter axle. The user can then hold one end of the canoe and either pull or push the canoe and gear to the desired location. Large diameter wheels on the toter position the canoe to approximately hip height so that the canoe is easy to grasp.

The invention will be move fully understood from the detailed description set forth below, which should be read in conjunction with the accompanying drawings. The invention is defined in the claims appended at the end of the detailed description, which is offered by way of example only.

DETAILED DESCRIPTION

Figure 1:
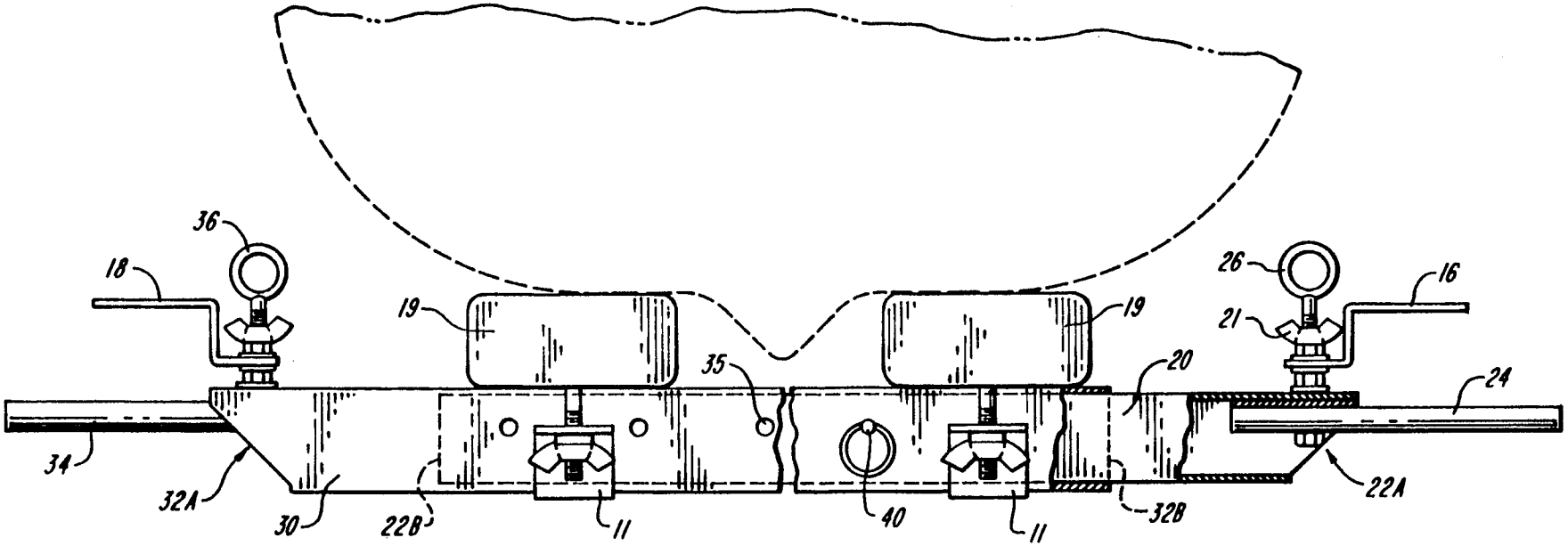
FIG. 1 is a plane front cut-away view of the canoe toter of the present invention.
Figure 2:
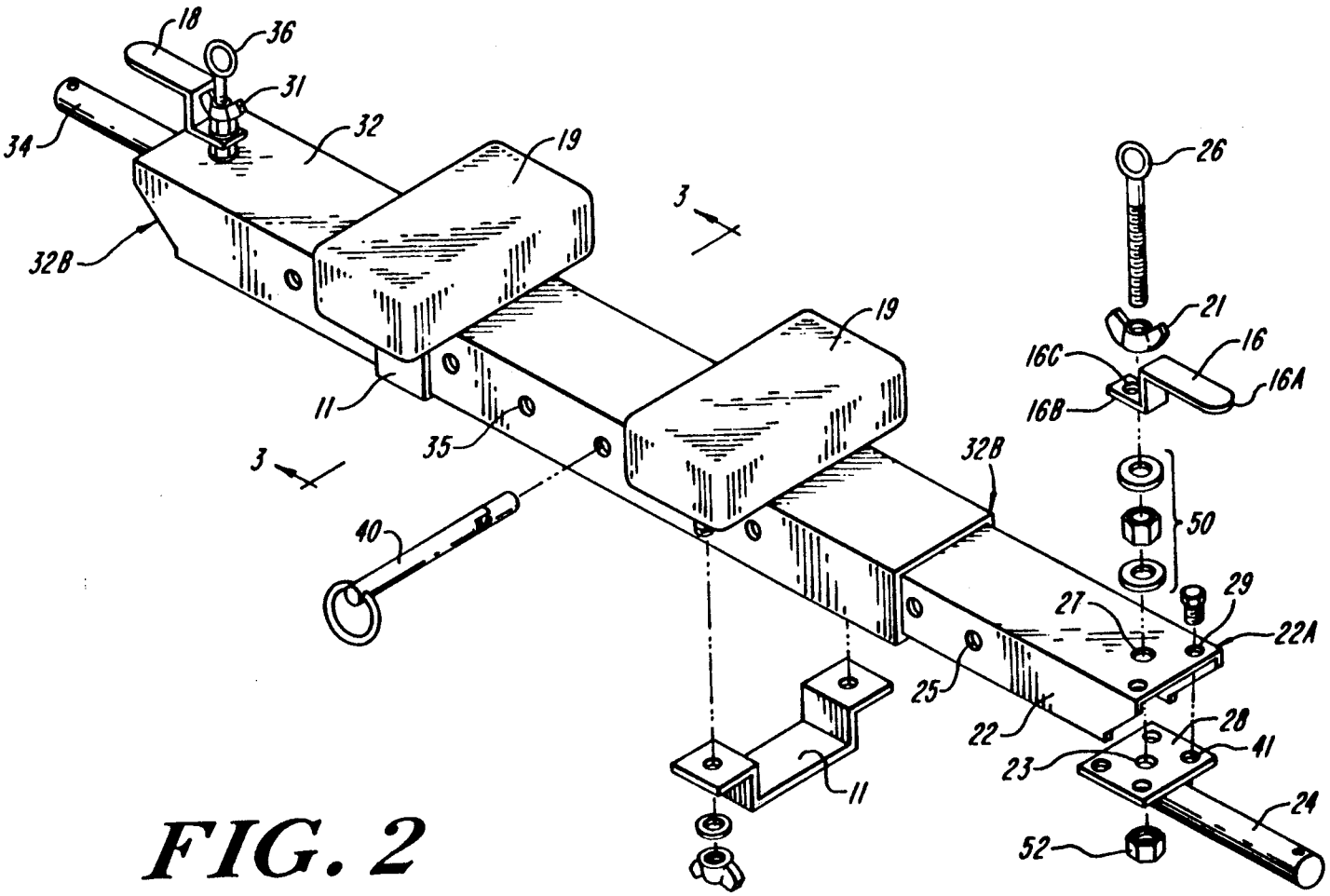
FIG. 2 is a plane perspective view of the canoe toter of FIG. 1.

Referring to the drawings, and in particular to FIGS. 1-2, an illustrative embodiment of a canoe toter 8 in accordance with the present invention, is shown. Canoe toter 8 comprises an axle 10, wheels 12 and 14, strap 15, guide assemblies 17 and wheel stabilizers 16 and 18.

In the illustrative embodiment, axle 10 comprises an inner axle member 20 and an outer axle member 30. Inner axle member 20 further comprises box-beam 22, axle shaft 24, eye-bolt 26 and mounting plate 28. Preferably, box-beam 22 is made from a metal, such as aluminum, formed into a three-sided square beam having a wall thickness of approximately 3/32", side widths of approximately 1⅜", a top surface width of approximately 2¾", and a length of approximately 30". The bottom edges 22E are bent inwardly at right angles from the front and back surfaces of the box-beam 22 to form a ledge like structure, approximately ⅜" wide, along the interior length of both surfaces. Axle end 22A of box-beam 22 contains a 45° cut in the front and back surfaces of the box-beam, as shown in FIG. 1.

A primary mounting hole 27 is bored through the top surface of box-beam 22. Primary mounting hole 27 has a diameter of approximately 5/16" and is spaced apart approximately 2" from axle end 22A of box-beam 22. A pair of secondary mounting holes 29 are bored through the top surface of box-beam 22 at the corners of axle end 22A. Secondary mounting holes 29 have a diameter of approximately ¼".

Axle shaft 24 is attached to the top interior surface of box-beam 22 with a mounting plate 28. Axle shaft 24 comprises a cylindrical shaft having a length of approximately 6⅜" and an outer diameter of approximately ⅝". Mounting plate 28 is formed of steel and has sides of approximately 2⅜". Mounting plate 28 is welded to the top surface of axle shaft 24. A primary mounting hole 23, having a diameter of approximately 5/16", extends through plate 28 and axle shaft 24. A pair of secondary mounting holes 41, having a diameter of approximately ¼", extend through two of the corners of plate 28, as illustrated in FIG. 2. Axle shaft 24 is mounted to the top interior surface of box beam 22 with eye-bolt 26 which extends through primary mounting hole 27 of box-beam 22 and mounting primary hole 23 of axle shaft 24 which are axially aligned, as indicated in FIG. 2. Eye-bolt 26 is secured in place with hex stop nuts. Axle shaft 24 is further secured against box beam 22 with a pair of bolts, secured with ⅛" locknuts, which extend through secondary mounting holes 29 of box-beam 22 and secondary mounting holes 41 of plate 28, only one of the screws being shown in FIG. 2 for the sake of simplicity. A small diameter bore, approximately ⅛" in diameter, extends through the opposite end of axle shaft 24 and receives a cotter pin to prevent the wheel 12 from slipping off the axle shaft, as explained hereinafter.

A plurality of adjustment holes 25 are bored through the front and back surfaces of box-beam 22. Adjustment holes 25 have a diameter of approximately ¼" and are spaced approximately 2½" apart along a straight line.

Outer axle member 30, the symmetrical reflection of outer axle member 20, comprises box-beam 32, axle shaft 34, eye-bolt 36 and a mounting plate (not shown) which is similar to mounting plate 28. Outer axle member 30 is substantially identical to outer axle member 20 except that box-beam 32 has side widths of approximately 2", a top surface width of approximately 3". Bottom edges 32E of box-beam 32 have a width of approximately ½". Box beam 32 has a length of approximately 30". Axle shaft 34 is coupled to box-beam 32 with mounting plate 38 in a manner similar to that of axle shaft 24 and box-beam 22, respectively.

Axle 10 is formed by coaxially positioning inner axle member 20 within outer axle member 30. This is accomplished by inserting penetrating end 22B of box-beam 22, shown in phantom in FIG. 1, into receiving end 32B of box-beam 32 so that bottom edges 22E of box-beam 22 rest on bottom edges 32E of box-beam 32. Inner axle member 20 is slidable within outer axle member 30, thereby enabling the aggregate length of axle 10 to be set between approximately 30"-50", as desired.

The length of axle 10 is fixed by inserting a pin 40 into the axially aligned adjustment holes 25 and 35 of box-beams 22 and 32, respectively, thereby securing inner axle member 20 within outer axle member 30. Pin 40 may be a quick release marine pin having a ring pivotally attached at one end and a spring-loaded bearing mounted in the opposite end.

Figure 3:
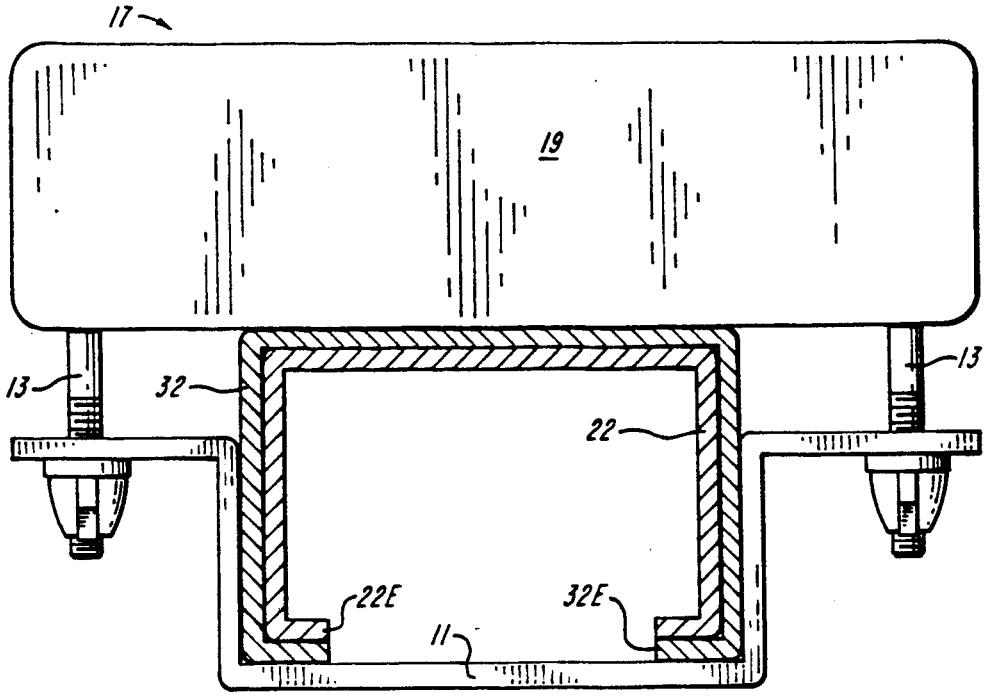
FIG. 3 is a cross sectional view of the canoe toter of FIG. 2 as seen along line 3—3.

A pair of semi-pneumatic wheels 12 and 14, having a diameter of 20" or greater, are rotatably mounted to axle shaft 24 and axle shaft 34 respectively, as shown in FIG. 3. Wheels 12 and 14 are each flanked by a pair of 5/8" washers and retained on their respective axle shafts with hairpin cotter pins and are easily dismounted to facilitate ease of storage and transportation of canoe toter 8, when not in use. The diameter of wheels 12 and 14 enable axle 10 and the marine craft to ride high enough to clear many obstructions. In addition, the craft rests on axle 10 at a level at which the user may more comfortably grasp the craft over extended periods. In a preferred embodiment, wheels 12 and 14 have spoked rims which co-act with wheel stabilizers 16 and 18, respectively, as explained hereinafter.

As shown in FIGS. 1 and 2, wheel stabilizer 16 comprises a metal tongue formed at right angles into a configuration having a step like cross-section, an overall length of approximately 2⅝" and an overall height of approximately 1⅛". A mounting hole 16C, having a diameter of approximately ⅛", extends through the rectangular shaped end 16B of wheel stabilizer 16. End 16A of wheel stabilizer 16 has a semi-circular shape to prevent abrasive interaction with the spokes of the respective wheels. Wheel stabilizer 16 may have an upper segment length of approximately 2⅝" and a lower segment length of approximately 1¼". Wheel stabilizer 18 is shaped similarly to wheel stabilizer 16.

Wheel stabilizer 16 is mounted to axle 10 as follows. The bottom surface of wheel stabilizer 16 is separated from the top surface of box-beam 22 by a hex nut and washer which are axially aligned with mounting hole 16C at the rectangular end of the wheel stabilizer. A washer, lock washer and wing nut 21 are axially aligned with mounting hole 16C on the upper surface of wheel stabilizer 16. Eye bolt 26 is threaded through wing nut 21, washers and nuts 50 and is secured at the undersurface of axle shaft 24 by nut 52, as indicated. Washers flank the top and bottom surfaces of wheel stabilizer 16 and allow the stabilizer to pivot over approximately 360° or to be locked in a specific position by tightening wing nut 21 threaded over eye-bolt 26. Wheel stabilizer 18 is similarly mounted to box-beam 32 with eye-bolt 36 and its accompanying wing nut 31, washers and nuts.

It is desirable to prevent wheels 12 and 14 from rotating about axle 10 when positioning a canoe or similar marine craft thereon. Wheel 12 is stabilized, or prevented from rotating, by pivoting wheel stabilizer 16 so that it is aligned with axle shaft 24. In this position, the rounded end 16A of wheel stabilizer 16 is disposed intermediate at least two spokes of wheel 12, thereby preventing rotation of the wheel in either direction. Wing nut 21 is then tightened to temporarily secure wheel stabilizer 16 in position. Wheel stabilizer 18 is similarly positioned to engage wheel 14. Once the canoe or marine craft is secured on canoe toter 8, wing nuts 21 and 31 are loosened and wheel stabilizers 16 and 18, respectively, pivoted away from their respective wheels.

It will be obvious to those reasonably skilled in the art that the implementation of wheel stabilizers 16 and 18 is dependent upon the structure and design of wheels 12 and 14. In an embodiment in which wheels 12 and 14 have solid rims, wheel stabilizers 16 and 18 may have a rubber stop or foot at the rounded end to engage the wheel rim and prevent movement thereof.

Referring to FIGS. 1–3, a pair guide assemblies 17 are moveably mounted to axle 10. Guide assemblies 17 each comprise a pad 19 and a U-shaped bracket 11. Each pad 19 comprises a substantially rectangular shaped wood block having a height of approximately 2", a width of approximately 4" and a length of approximately 14". The wood blocks are covered with corrugated vinyl rug to prevent damage to the undersurface of the marine craft. Each pad 19 has a ⅜" carriage bolt 13 secured at each end and extending downwardly from the bottom surface thereof, as shown in FIG. 3.

Each guide assembly 17 further comprises a U-shaped bracket 11 which is sized and dimensioned to mimic the contour of either box-beam 20 or box-beam 30. The extremities of U-shaped bracket 11 are formed at right angles and have holes extending therethrough for receiving the carriage bolts of pad 19. U-shaped bracket 11 may have an overall length of 5⅞" and a width of 1½" inches.

Guide assembly 17 is attached to axle 10 by placing pad 19 adjacent the top surface of either axle member so that the carriage bolts extend downward. U-shaped bracket 11 is positioned adjacent the underside of the respective axle member so that the carriage bolts project downward through U-shaped bracket 11. Guide assembly 17 is then secured in place by threading a wing nut about each carriage bolt 13.

Figure 4:
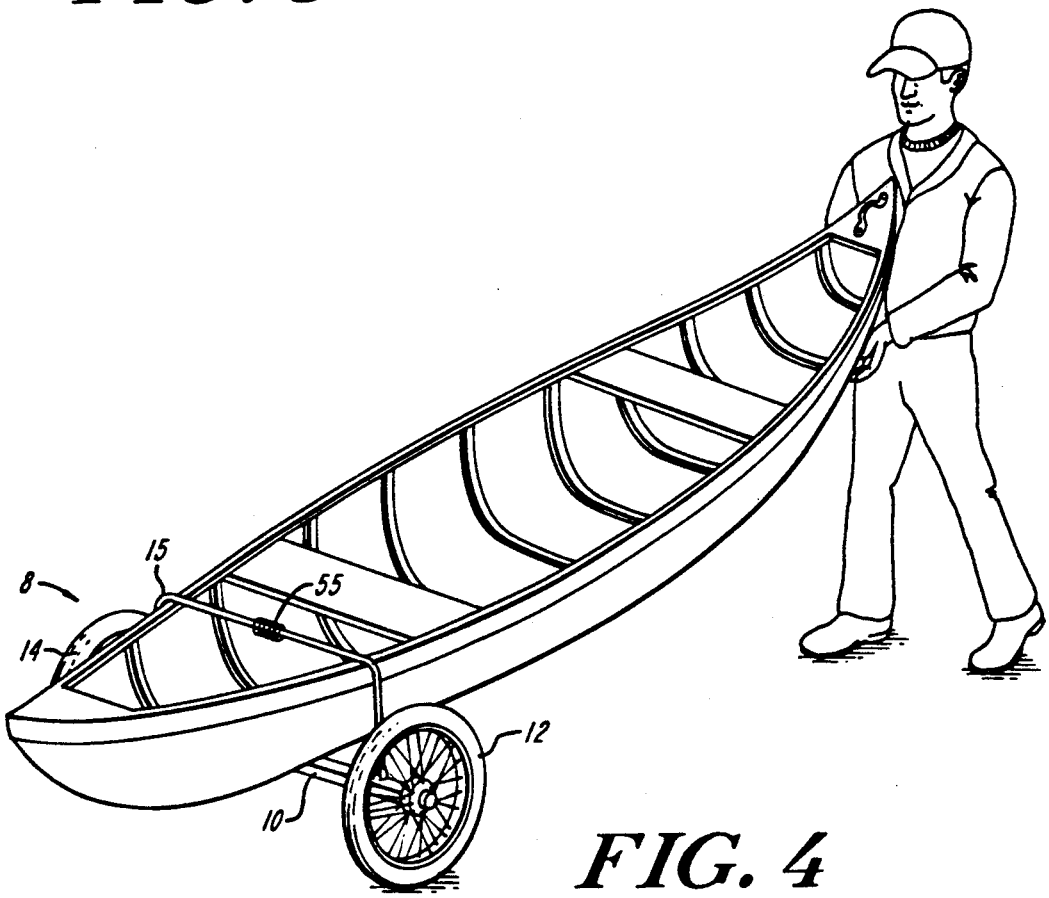
FIG. 4 is a perspective view of the canoe toter of the present invention illustrating its proper use.

An adjustable length strap 15, shown in FIG. 4, is coupled to axle 10 to secure the canoe or similar marine craft against guide assemblies 17. Strap 15 may comprise 1" nylon webbing or any number of fabrics woven for strength and durability. Strap 15 is divided into two connectible sections, the first section being secured to eye-bolt 26 of inner axle member 20 and the second section being attached to eye-bolt 36 of outer axle member 30. One section of strap 15 has attached at the end thereof, a quick release buckle for securing the two strap sections together about the gunwales of the canoe or similar marine craft. Strap 15 may have a combined overall length of approximately 9½' to accompany marine craft of varying sizes. One section of strap 15 has a thumb-cam buckle secured thereto for adjusting the length of that strap section and the overall length of the strap 15. Once the canoe or similar marine craft is positioned on guide assemblies 17, the sections of strap 15 are coupled and pulled tightly over the gunwales of the craft to secure it against axle 10. The flexible material from which the strap is made will not harm or damage the marine craft.

The assembly and use of canoe toter 8 is as follows. Axle 10 is formed by inserting inner axle member 20 into outer axle member 30, and adjusting the aggregate length of axle 10 to the width of the canoe. Pin 40 is then inserted into both outer axle member 30 and inner axle member 20, thereby fixing the length of axle 10. Wheels 12 and 14 are then mounted onto axle shafts 24 and 34, respectively, and retained thereon with cotter pins. Once the length of axle 10 is fixed, guide assemblies 17 are secured to axle 10 and spaced apart from one another, a distance which will, both support and protect the underside of the craft from axle 10. Next, wheel stabilizer 16 is pivoted into interfering contact with the spokes of wheel 12 and temporarily secured in place. Likewise, wheel stabilizer 18 is pivoted into interfering contact with the spokes of wheel 14 and temporarily secured in place. Wheel stabilizers 16 and 18 prevent the rotation of wheels 12 and 14, respectively, about axle 10 and thereby maintaining canoe toter 8 stationary to facilitate positioning of a craft thereon. A canoe or similar marine craft is positioned on axle 10 so that the underside of the craft rests on pads 19 of guide assemblies 17 which both support and separate the craft from the top surface of axle 10. The sections of strap 15 are then buckled by means of buckle 55 together and the strap length adjusted and pulled taunt about the gunwales of the craft to retain the craft adjacent guide members 17 and axle 10. Once the canoe is secured, wheel stabilizers 16 and 18 may be disengaged from wheels 12 and 14, respectively, and rotated to their normal positions.

The user of canoe toter 10 may then stow his gear and other equipment in the interior of the canoe. As shown in FIG. 4, the user then grasps the opposite end of the canoe and pushes or pulls the craft to the desired body of water.

Having thus described one particular embodiment, various alterations, modifications and improvements will readily occur to those skilled in the art. Such alternations, modifications and improvements as are made obvious by this disclosure are intended to be part of this disclosure though not expressly stated herein, and are intended to be within the spirit and scope of the invention. Accordingly, the foregoing description is intended to be exemplary only and not limiting. The invention is limited only as defined in the following claims and equivalence thereto.

What is claimed:

1. An apparatus for manually transporting a marine craft having a width and a bottom surface, said apparatus comprising:

an axle, having a length, a longitudinal axis, a first and second end and a top surface against which said marine craft rests;

means for adjusting said axle length to accommodate said marine craft width;

a pair of wheels, one of said pair of wheels being perpendicularly and rotatably mounted on said first axle end and the other of said pair of wheels being perpendicularly and rotatably mounted on said second axle end;

stabilizing means, coupled to said axle, for preventing the rotation of at least one of said pair of wheels about the respective axle end to which said one wheel is mounted, said stabilizing means comprising a tongue rotatably mounted on a pivot, said pivot being located on said axle axis and extending perpendicularly thereto, fastener means for frictionally holding said tongue in selective engagement with said at least one wheel whereby when said fastening means is loosened, said tongue is allowed to rotate about said pivot and disengage from said at least one wheel; and securing means, coupled to said axle, for receiving and securing said marine craft adjacent said axle top surface.

2. The marine craft transporting apparatus of claim 1 wherein said stabilizing means comprises a pair of tongues, one of said pair of tongues being pivotally mounted at said first axle end for interfering engagement with a first of said pair of wheels attached at the first axle end, and the other of said tongues being pivotally mounted at said second axle end for selective interfering engagement with a second of said pair of wheels mounted at the second axle end.

3. The marine craft transporting apparatus of claim 2 wherein each of said pair of wheels comprises a hub having a plurality of radially extending spokes projecting therefrom and wherein one of said tongues has a free end which may be received between two of said plurality of spokes to prevent rotation of said wheel about the respective axle end to which the wheel is attached.

4. The marine craft transporting apparatus of claim 1 wherein said securing means comprises a pair of resilient guide members attachable adjacent said axle top surface for receiving the bottom surface of said marine craft.

5. The marine craft transporting apparatus of claim 4 wherein said securing means further comprises a flexible strap means securing to said axle and having a buckle for securing said marine craft adjacent said guide members and said axle top surface.

6. The marine craft transporting apparatus of claim 3 wherein said free end of said one of said tongues is rounded.

7. An apparatus for manually transporting a marine craft having a width and a bottom surface, said apparatus comprising:

an axle having a length, first nd second ends and a top surface against which said marine craft rests;

means for adjusting said axle length to accommodate said marine craft width;

a pair of wheels, one of said pair of wheels being perpendicularly and rotatably mounted on said first axis end and the other of said pair of wheels being perpendicularly and rotatably mounted on said second axle end;

a pair of resilient guide members attachable adjacent said axle top surface for accommodating the bottom surface of the marine craft;

a flexible strap means secured to said axle and having a buckle for securing the marine craft adjacent the guide members; and stabilizing means, coupled to the axle, for preventing the rotation of at least one of said pair of wheels about the respective axle end to which said at least one wheel is mounted, said stabilizing means comprising a tongue rotatably mounted on a pivot, said pivot being located on said axle axis and extending perpendicularly thereto, fastener means for frictionally holding said tongue in selective engagement with said at least one wheel whereby when said fastening means is loosened, said tongue is allowed to rotate about said pivot and disengage from said at least one wheel.

8. The marine craft transporting apparatus of claim 7 wherein said stabilizing means comprises a pair of tongues, one of said pair of tongues being pivotally mounted at said first axle end for interfering engagement with a first of said pair of wheels attached at the first axle end, and the other of said tongues being pivotally mounted at said second axle end for selective interfering engagement with a second of said pair of wheels mounted at the second axle end.

9. The marine craft transporting apparatus of claim 8 wherein each of said pair of wheels comprises a hub having a plurality of radially extending spokes projecting therefrom and wherein one of said tongues has a free end which may be received between two of said plurality of spokes to prevent rotation of said wheel about the respective axle end to which the wheel is attached.

10. The marine craft transporting apparatus of claim 9 wherein said free end of said one of said tongues is rounded.

11. An apparatus for manually transporting a marine craft having a bottom surface, said apparatus comprising:

an axle having an outer axle member with a cross-sectional shape and an inner axle member, said inner axle member having a cross-sectional shape corresponding to said outer axle member cross-sectional shape and having a smaller size than said outer axle member cross-sectional shape so that said inner axle member slides within said outer axle member forming a telescoping axle with a length adjustable over a predetermined range, said axle having a first and a second end and a top surface adjacent which said marine craft rests;

a pair of wheels, one of said pair of wheels being perpendicularly and rotatably mounted on said first axle end and the other of said pair of wheels being perpendicularly and rotatably mounted on said second axle end;

stabilizing means, coupled to said axle for preventing the rotation of at least one of said pair of wheels about the respective axle end to which said at least one wheel is mounted, said stabilizing means comprising a tongue rotatably mounted on a pivot, said pivot being located on said axle axis and extending perpendicularly thereto, fastener means for frictionally holding said tongue in selective engagement with said at least one wheel whereby when said fastening means is loosened, said tongue is allowed to rotate about said pivot and disengage from said at least one wheel; and securing means, coupled to said axle, for receiving and securing said marine craft adjacent said axle top surface.

12. The marine craft transporting apparatus of claim 11 wherein said stabilizing means comprises a pair of tongues, one of said pair of tongues being pivotally mounted at said first axle end for interfering engagement with a first of said pair of wheels attached at the first axle end, and the other of said tongues being pivotally mounted at said second axle end for selective interfering engagement with a second of said pair of wheels mounted at the second axle end.

13. The marine craft transporting apparatus of claim 12 wherein each of said pair of wheels comprises a hub having a plurality of radially extending spokes projecting therefrom and wherein one of said tongues has a free end which may be received between two of said plurality of spokes to prevent rotation of said wheel about the respective axle end to which the wheel is attached.

14. The marine craft transporting apparatus of claim 11 wherein said securing means comprises a pair of resilient guide members attachable adjacent said axle top surface for receiving the bottom surface of said marine craft.

15. The marine craft transporting apparatus of claim 14 wherein said securing means further comprises a flexible strap means secured to said axle and having a buckle for securing said marine craft adjacent said guide members and said axle top surface.

16. The marine craft transporting apparatus of claim 11 wherein said axle can be fixed to a predetermined length by a pin passing through aligned apertures in said inner axle member and said outer axle member.

17. The marine craft transporting apparatus of claim 13 wherein said free end of said one of said tongues is rounded.

* * * * *